US005687971A

United States Patent [19]

Khaladkar

[11] Patent Number: 5,687,971

[45] Date of Patent: Nov. 18, 1997

[54] BINGO GAME MANAGEMENT METHOD

[75] Inventor: Vikas Khaladkar, Regina, Canada

[73] Assignee: Wascana Gaming Inc., Regina, Canada

[21] Appl. No.: 499,418

[22] Filed: Jul. 7, 1995

[51] Int. Cl.[6] ..... A63F 3/06; G06F 15/44

[52] U.S. Cl. ..... 273/269; 463/19; 463/16

[58] Field of Search ..... 463/16, 19, 29, 463/30–31, 40–42; 364/410, 412, 471, 478, 479; 283/49, 903; 273/237, 269, 139, 274

[56] References Cited

U.S. PATENT DOCUMENTS

| | | | |
|---|---|---|---|
| 4,087,092 | 5/1978 | Krause et al. | 463/29 |
| 4,373,726 | 2/1983 | Churchill et al. | 463/29 |
| 4,624,462 | 11/1986 | Itkis | 273/269 |
| 4,661,906 | 4/1987 | DiFrancesco et al. | 273/269 |
| 4,669,729 | 6/1987 | Solitt et al. | 463/29 |
| 4,830,380 | 5/1989 | Six | 273/269 |
| 4,856,787 | 8/1989 | Itkis | 273/269 |
| 4,875,686 | 10/1989 | Timms | 273/269 |
| 4,882,688 | 11/1989 | Kondziolka et al. | 273/269 |
| 4,885,700 | 12/1989 | Kondziolka et al. | 273/269 |
| 4,909,516 | 3/1990 | Kolinsky | 463/19 |
| 5,007,649 | 4/1991 | Richardson | 273/269 |
| 5,178,395 | 1/1993 | Lovell | 273/269 |
| 5,188,370 | 2/1993 | Vlahos | 273/269 |
| 5,297,802 | 3/1994 | Pocock et al. | 463/19 |
| 5,351,970 | 10/1994 | Fioretti | 463/19 |
| 5,417,424 | 5/1995 | Snowden et al. | 364/412 |
| 5,472,209 | 12/1995 | Goldfarb | 463/19 |

FOREIGN PATENT DOCUMENTS

| | | |
|---|---|---|
| 2280615 | 2/1995 | United Kingdom . |
| WO86/04826 | 8/1986 | WIPO . |
| WO96/16819 | 6/1996 | WIPO . |

*Primary Examiner*—Jessica Harrison
*Assistant Examiner*—Mark A. Sager
*Attorney, Agent, or Firm*—Adrian D. Battison; Murray E. Thrift

[57] ABSTRACT

A bingo system for managing bingo games includes a central computer and a printer which is usually located on site at the game location. The computer stores a series of bingo cards in memory and is arranged to printout the bingo cards on pages or in books for playing by the players. The computer can be programmed in dependence upon the requirements of the bingo hall management to customize the pages and books to particular games and game formats. Each bingo page or bingo book printed carries a bar code which is associated in the memory of the computer with all of the bingo cards in the page or book sold. The location is supplied with a plurality of portable bar code readers which are used by the cashier and floor runners to read the bar codes of papers and books to be purchased. The central computer communicates price information to the readers and can decline a paper or book if it contains duplicates of bingo cards already sold for that game. When commencing the bingo game, therefore, the computer has information identifying all of the bingo cards sold for that game for record purposes and for confirming that the winning card is one which was properly sold for that game.

13 Claims, 3 Drawing Sheets

| B | I | N | G | O |
|---|---|---|---|---|
| N1 | N2 | N3 | N4 | N5 |
| | | N6 | | |
| | | | | |
| | | N7 | | |
| | | N8 | | |

BINGO GAME MANAGEMENT METHOD

This invention relates to a method of managing a bingo game and particularly to the computerized tracking and production of bingo cards sold in a bingo establishment in order to ensure that all cards in play can be specifically identified for the purposes of determining the winner of the game.

The process eliminates the possibility of various kinds of fraud, collusion, conspiracies, thefts and other types of defalcations commonly occurring in bingo establishments, and allows for paper and electronic bingo card winners to have their winning cards to be verified by individualized ticket number, serial number, date of manufacture and/or other security information which protects the integrity of the card and the game.

The process also allows for the printing of advertising on bingo paper which is current, inexpensive and provides revenue streams to bingo hall establishments which they have not previously enjoyed.

BACKGROUND OF THE INVENTION

Bingo establishments commonly utilize pre-printed sheets of paper containing 12, 9, 6, 3 or 1 bingo cards for sale to its customers. These sheets of paper are collated by hand, or purchased pre-collated, for sale during bingo sessions. It is necessary to keep manual track of the cards sold in order to determine the gross sales per session. In most jurisdictions the quantum of prizes offered to patrons of bingo establishments is based upon a percentage of gross sales achieved, with minimum and maximum prize boards dictated by government regulation.

Bingo establishments generally have on hand thousands of sheets of bingo paper at any given time. The bingo paper constitutes the inventory of these establishments. Ordinarily it is difficult to control this inventory since a large number of persons, including bingo establishment personnel and volunteers representing various charities, authorized and unauthorized, have access to the paper on a daily basis. In many jurisdictions the bingo paper is not sold through any form of cashier system but, rather, money is collected from bingo hall patrons at the time of sale with no record by card or serial number of the actual sale.

There is currently no automation in the process of producing and selling bingo cards. As a result, bingo establishments find it time consuming and difficult to keep accurate track of sales. Accordingly, reporting to regulatory agencies and owner groups is often fraught with difficulty since it is sometimes impossible to reconcile, from an accounting and reporting perspective, the activities in any particular bingo session.

Verification systems to identify legitimate bingo winners which are currently sold on the market do not identify the winning bingo card by series number or any other security sensitive information. Accordingly, in jurisdictions which allow the sale of duplicate cards in a game, it is impossible to determine whether or not a "winner" has a bona fide card. Verification takes place by entering the serial number of the card in the verifier, and a computer image of the bingo card is broadcast on monitors in the bingo establishment in order for players to see for themselves whether the card contains the winning combination of numbers. An unscrupulous bingo caller can, in the case of multiple winners, simply punch in the same card number in order to verify the non-existent bingo of an accomplice. In jurisdictions allowing duplicate cards, this practice is all too common and operates to the very real detriment of the bingo player.

There are a number of computerized bingo terminal systems on the market which allow players to play their cards electronically. However, we are not aware of any system which has the capacity to either efficiently produce and keep track of the sales of paper cards or to verify each and every paper card sold by serial and card number.

It is known in the prior art that some bingo cards are printed with bar codes. However this bar code information is simply used to identify the type of paper or book being sold so as to generate price information for the cashier.

Further prior art is disclosed in U.S. Pat. No. 4,885,700 (Kondziolka et al) issued in 1989. This discloses a bingo management system for on site printing of bingo cards. The system provides a computer which directly on site generates internally a series of bingo cards up to a required number to be printed. The computer internally checks the bingo cards generated randomly to ensure that there are no duplicates and, when the required number is reached, acts to directly print the cards onto paper for sale at the location. This system can therefore be used to generate customized bingo cards and ensures that there are no duplicates by only printing the required number of cards and by ensuring that there are no duplicates in that required number. However the system is somewhat limited in that it cannot manage the bingo game to prevent manipulation by players or by the management.

SUMMARY OF THE INVENTION

The inventive idea consists of the production of bingo paper on site in order to maximize security and generate revenue for bingo establishments. This idea flows from the software program that we have developed for use in the management of bingo operations. We believe that we are the first to develop an integrated security, accounting and on site printing solution for the problems faced by the bingo industry.

According to the first aspect of the invention there is provided a method of playing a series of bingo games in a bingo session comprising: providing a central computer having a memory; placing in the memory a series of bingo cards; providing at least some of the series of bingo cards printed on paper to form a number of printed bingo cards, each printed bingo card having associated therewith a printed machine readable code identifying the respective bingo card of the series; for each bingo game of the series, selling to players at least some of the printed bingo cards and using code reader means to read the code associated with each printed bingo card sold for said each bingo game to input into the central computer information identifying those printed bingo cards sold for said each bingo game; and, after said each bingo game is played by the players for a player to identify a winning bingo card of said each bingo game, using the central computer to verify that the winning bingo card is properly one of the bingo cards sold for said each bingo game.

The ability to keep track of every card being played in a bingo game provides bingo establishments with the ability to guarantee one hundred percent reliability and security in the game. Players can confidently play the game knowing that they are not being cheated. Bingo establishment owners and operators can also benefit form the knowledge that only the cards legitimately in play constitute "inventory", and that fraudulent practices such as the selling of unauthorized bingo paper by bingo hall personnel, paper switching or playing with bingo cards not sanctioned, through sale, by the bingo establishment cannot take place.

We have found that the lack of control and security in the present system of playing bingo can be overcome by means of printing bingo paper which is bar coded to contain specific information about each ticket sold. On site printing also confers additional advantages in the form of increased earnings for bingo establishments from potential advertising revenue. Off site printing can be utilized by a number of smaller bingo establishments to achieve economies of scale. However, the inventive idea incorporated in this application is not compromised by off site printing since bingo paper still does not become inventory until it has been scanned through our bar code reading system. This latter point is dealt with more exhaustively on the following page.

Bar coding can be effected by a conventional bingo paper manufacturer at the printing plant using conventional printing technologies. However, when using conventional printing and collating technologies, it is all too possible for an extra sheet to be added into a book of bingo cards, or for a sheet to be dropped, in the collating process. When this happens the entire production run from the point of the mistake becomes tainted, if one is attempting to verify legitimate tickets by book numbers, or to load this data into a computerized verification system, since the appropriate bingo cards are not located in the appropriate books, and conventional verification systems are unable to detect the collating mistake. It is, therefore, impossible for a conventional verification system to keep track of bingo paper by the book and verification by individual card has been the only alternative. In practice, this has led to an inability by extant verification systems to verify anything other than the face of the ticket being presented as a winning ticket. Important information, from a security point of view, such as the serial number of the ticket or the date of its production, cannot be verified in existing systems.

In our system, bar coding takes place through a computer program which we have devised to identify each ticket in each series of tickets sold in the bingo establishment. The computer program commands a high speed printer to print number of "books" of tickets required by the bingo establishment for a bingo session. Our system uses a single sheet of paper for the entire book with memory folds at certain perforations which define the page size. So, for example, there is a memory fold at the end of the second row of tickets to create 6 up and 12 up paper. There is a memory fold at the end of the 3rd row of tickets to create 9 up, 15 up and 18 up paper. In the case of 15 ups, the printer does not print any numbers on the bottom row of tickets.

Collating, stapling and binding adds another step of handling to the procedure which is unnecessary. Also, it adds to the possibility, in the collating process, that a sheet can be misfed, which would seriously compromise our ability to effectively keep track of sales and the verification process. If one book ends up with too many sheets of paper, or not enough, it throws the entire series of books to be produced "out of whack", and proper tracking becomes impossible.

The high speed printing has, in memory, the entire sequence of tickets to be printed. In the event of a paper jam or other mechanical error encountered during the printing run, the printer keeps track of the sheets actually printed, and begins its run again at the point of failure. Accordingly, each run of printed books manufactured by using our system is guaranteed to contain only those bingo cards which are destined to be there, and no others. Verification can, in our system, take place by ticket number, serial number, date of production of the bingo paper, place of production of the bingo paper and a number of other variables which may be considered necessary from a security standpoint.

Moreover, the printed paper manufactured by the use of our printing system does not become inventory until it is swiped by a bar code reader, which automatically loads the sold and swiped tickets into the verifier and cashier portions of our computerized bingo program.

Since bingo cards are also commonly sold on the floor directly to customers, floor vendors of bingo cards utilizing our system will carry portable bar code readers which also identify for our computer program the tickets which are in play. The portable bar code readers electronically and wirelessly advise the cashier and verification programs of the sales each floor vendor has effected. In addition, the bar code reader automatically advises the floor vendor of the total amount of the sale to each customer in order to facilitate the making of correct change.

The verifier thus contains an actual, sale by sale, inventory of each ticket sold for each game while, at the same time, keeping ongoing track of sales by each cashier and floor vendor to facilitate accounting at the end of the bingo session. This process makes each vendor of bingo cards accountable for the tickets actually sold, a system which is neither automated nor in place in the vast majority of bingo establishments in North America.

At the end of each session, the computer program automatically remits to any number of programmable telephone numbers, including, for example, regulatory bodies, owner groups, etc. a complete accounting for the session. The accounting includes a breakdown of paper and electronic bingo cards sold, a reconciliation of the cards sold and cash collected including an identification of inconsistencies by each individual vendor, a listing of the games played, the relevant patterns, the balls called by the caller in the order in which they were called and other pertinent information essential to the proper and efficient conduct of the game of bingo.

The ability to print bingo paper on site as per daily paper requirements is unique. Until now bingo establishments have had no option but to buy pre-printed bingo cards from manufacturers of same. This bingo paper is printed using conventional web press technologies which includes the use of printing plates. In our system all relevant information is electronically conveyed by computer to a high speed printer. This gives the bingo establishment the ability to print, on demand, only as many bingo cards as are necessary for any given session. In addition, by merging the information relating to card numbers with new electronic information, it is possible to add unique data, such as advertising, to each sheet of bingo paper printed. The sales of advertising space on bingo paper by bingo establishments is expected to not only significantly offset the cost of production the bingo paper but, we believe, will add a dimension of revenue generation for bingo establishments which did not previously exist.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
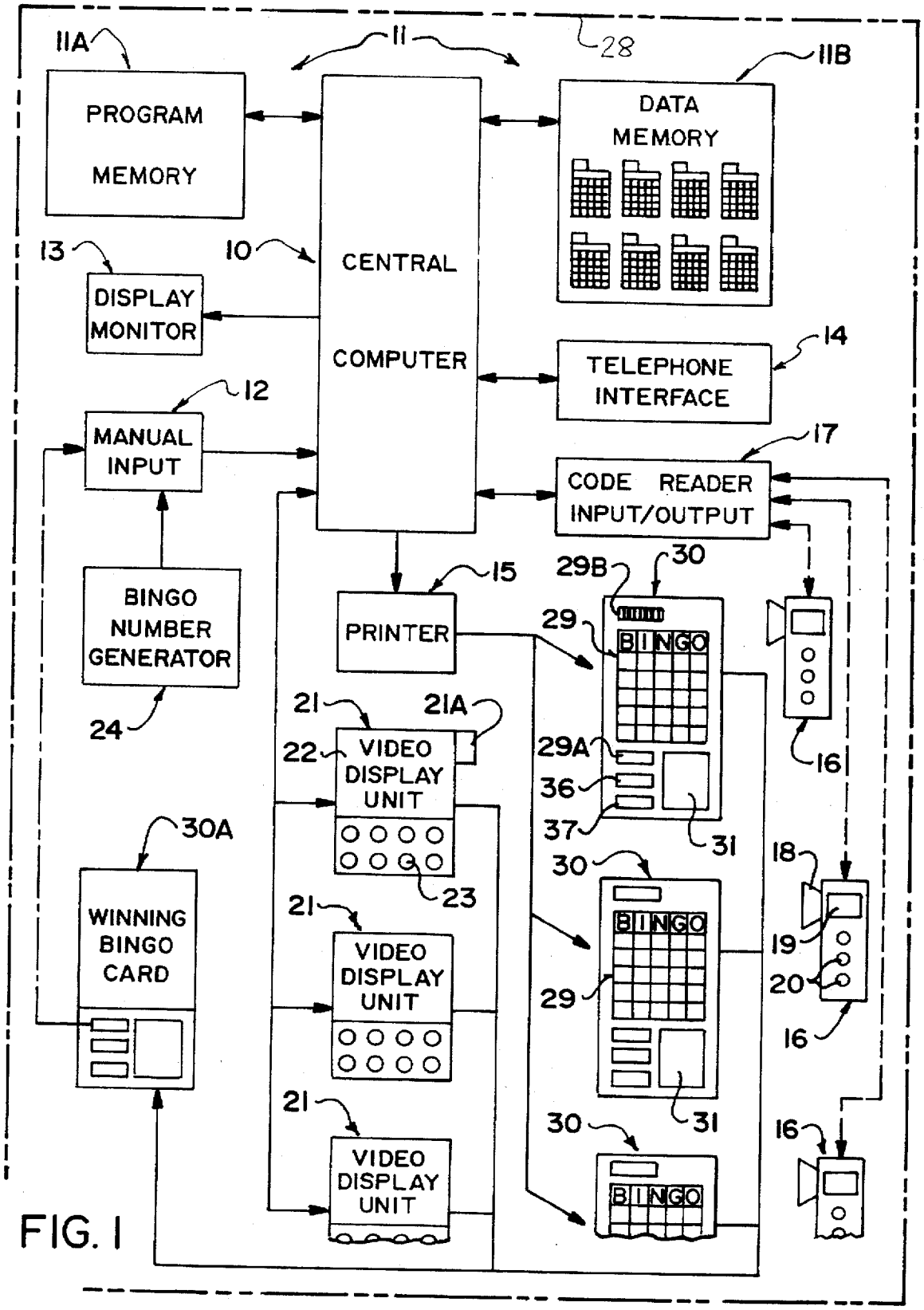
FIG. 1 is a schematic illustration of the system which is arranged on site at the location for playing a bingo game.

The system for playing the bingo game shown in FIG. 1 comprises a central computer 10 which can be for example "a file server in a local area network (LAN) which contains the database upon which all other components of the computer system rely for any common information required to operate the system, or it can be a peripheral computer in the local area network which has the specific task of processing certain types of data based upon selected information which is received by said peripheral computer. These peripheral computers in the local information which is received by said peripheral computer. These peripheral computers in the local area network operate in conjunction with the file server and, for example, can be assigned to tasks such as recording sales (the cashier terminal) or verifying winning tickets (the verifier terminal). The central and peripheral computers include as conventional hardware a memory 11 which for convenience of illustration is divided into two memory sections indicated at a program memory 11A and a data memory 11B. The hardware further includes a conventional manual input keyboard 12, a display monitor 13, a telephone interface 14 and a printer 15. All of these items are readily commercially available and the details will be well known to one skilled in the art.

The hardware is further supplemented by the addition of a plurality of portable bar code readers indicated at 16 and a code reader input/output 17. The bar code readers 16 are again of a conventional nature and commercially available and each comprises a portable element which can be manually carried and includes a laser bar code reader element 18 attached to a hand held unit with a display 19 and a plurality of manual key elements 20. The portable bar code reader further includes a communication element which allows wireless communication from each of the portable bar code readers independently to the input/output unit 17. The input/output unit 17 is connected to a suitable port on the central computer and/or peripheral computers to allow two way communication between the bar code readers and the computer to allow the input into the computer of information from the bar code reader and to allow communication of information from the computer to the bar code readers for display on the screen 19.

The hardware further includes a plurality of video display units 21 each of which is arranged for displaying one or more bingo cards on a display screen 22 and each of which includes a touch screen input 23 for playing the bingo game displayed on the display unit. The video display units are arranged such that in automatic mode, the player's terminal does all the work except alerting the caller to the fact that the player has won a bingo—the player has won a bingo—the player must still do that. In manual mode, there are keys on screen which the player must touch in order to alert his/her terminal that a particular ball has been called. This has the effect of canceling that number on all of the customer's electronic tickets.

The apparatus further includes a conventional bingo number generator 24 operated by the bingo caller who uses the manual input 12 to enter into the central computer and particularly the data memory 11B thereof the numbers called in a particular bingo game.

The central computer is arranged to receive a previously generated series of bingo cards for playing in bingo games which are indicated generally at 29 and are entered in the memory 11B. The system for generating the series is not described herein as this is well known to one skilled in the art and such series are readily available from commercially available sources or random number generating programs.

The number of cards in the series is selected to be sufficient to allow the printing of enough cards for use in a bingo game without the necessity for any duplicates. Thus the system is arranged in dependence upon the likely number of players in a location in which the system is to be used. For example in very large bingo halls where up to 1500 players can be involved, more than 30,000 cards will be necessary in the series since each player can play at any one time more than 20 cards. However in most average size locations, a series of 30,000 bingo cards is sufficient.

Figures 3, 4:
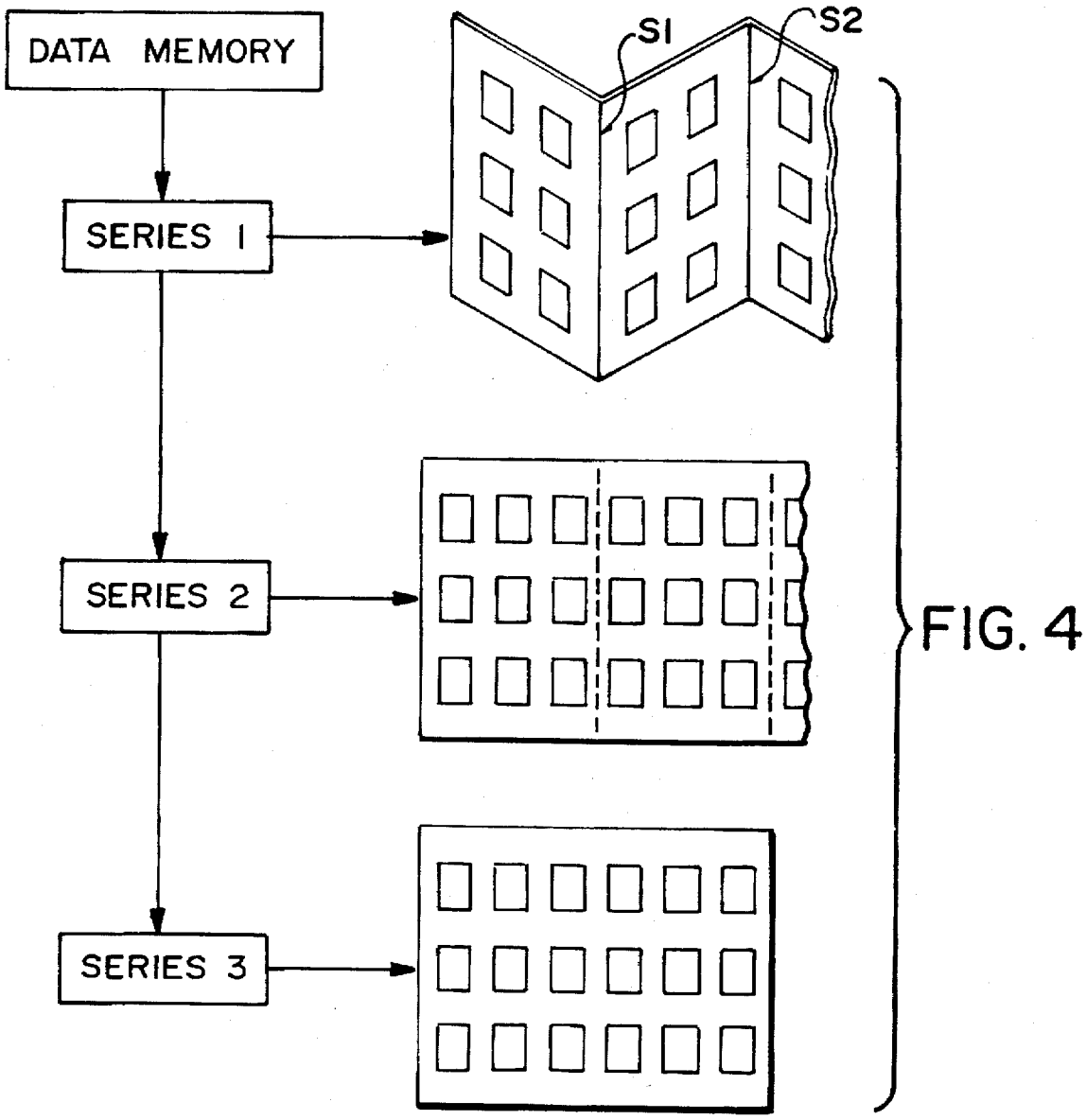
FIG. 3 is a schematic illustration of one printed bingo card of the type for playing a reduced format game in which the numbers for the game are printed only in the area of the required format and are omitted in the remainder of the matrix.
FIG. 4 is a schematic illustration of the system for generating a plurality of books of different numbers of bingo cards on each page of each book.

Turning now to FIG. 4, the system is arranged so as to provide a different series of bingo cards for each type of paper being sold on the floor, e.g. 6 ups, 12 ups, etc. and each series being different from the other series so as to contain a unique set of bingo cards within the series and in comparison with other series. Accordingly, each type of bingo paper to be printed can be printed using the respective different series of bingo cards in its entirety and used in the hall at different rates of use without increasing the possibility of duplicate bingo cards on the floor. The system of the present invention therefore as illustrated in FIG. 4 extracts from the data memory a plurality of series of the bingo cards which are different and separate and there is no duplication within a series or between the series of the bingo cards set forth in that series. Those individual series are then used to print the different paper sizes required.

Thus as shown at series 1 in FIG. 4 is provided a book of 6-up paper. The system uses a single sheet of paper for the entire book of individual bingo papers with memory folds at certain perforations as indicated at S1, S2 which define the page size. So, for example, there is a memory fold at the end of the second row of tickets to create 6-up and 12-up paper. There is a memory fold at the end of the third row of tickets to create 9-up, 15-up and 18-up paper. Series 2 shows the 9-up paper. Series 3 shows the 18-up paper. In the case of the 15-up paper, the printer does not print any numbers on the bottom row of tickets of the 18-up paper.

The use of a single paper which remains interconnected at the memory lines avoids collation, stapling and binding thus avoiding unnecessary steps and avoiding the possibility of the books becoming mis-colated.

In addition the use of totally different series of bingo cards for the different papers avoids any possibility of there being duplicate cards on the floor even though there may be different "up" papers from different printings on the floor at the same time.

To the best of our knowledge neither the conventional paper manufacturers nor Kondziolka in the above patent, have thought of this solution to the prevention of duplication. Conventional paper manufacturers are limited, by the web press technology which they use, to producing their cards with plates containing generally 36 cards. These are then cut down to make the various "ups". They are therefore using the same series of bingo cards for the various "ups". The advantages of our method would be apparent to anyone in the industry who are confronted with the method since one can have a number of different "ups" of paper on the floor, each corresponding to a unique series, without ever having to worry about duplicates among the different "ups" of paper.

Unlike Kondziolka's system, our paper series remains static, and a number generator is not used each time new paper is to be printed. This has the advantage, for regulatory and security purposes, of allowing us to reconstruct, if necessary, an entire game based upon the information contained in the computer as to the tickets which were in play and the numbers, and the order of the numbers, which were called. Additionally, unlike Kondziolka's system, our system is capable of much greater speed since the series is fixed. In order to generate 7 series of paper, with 30,000 tickets each, each ticket different from the other, would take a 486DX computer with 8 megabytes of RAM memory about 1.5 days. Printing would take an additional 3.0 hours using our technology. Kondziolka would have been using 286s, and probably could not generate and print tickets sufficiently quickly to look after the needs of a decent sized hall.

As is well known, the bingo card comprises a matrix of rows and columns with the columns headed at the top by the letters BINGO and including 5 rows. The bingo cards of the series therefore comprise a matrix of randomly selected numbers bearing in mind that only certain numbers can appear in the lines under each letter. The game is of course won by marking the numbers called in random sequence by the number generator 24 with the numbers on the card and by calling the word "BINGO" when all the numbers on the card for the pattern selected for the game have been called. Some games utilize all the numbers on the card. Some games utilize only some areas of the cards in patterns which are selected for that particular game such as a T-shape, C-shape or the like.

In FIG. 1, the location at which the bingo session is to take place is schematically indicated at 28 so that the central computer and its associated elements including the printer 15 are all located at the location where the bingo game is to take place.

Such a system is suitable in a situation where the session holds enough players to justify the location of the printer 15 as a dedicated printer at the location concerned. In other smaller locations, it is possible that the printer can be located at a separate location fed by a separate computer system which incorporates the same data memory including the bingo cards 29. In such a situation, therefore, the separate computer and separate printer associated with the separate computer can be used to print bingo cards for relatively small locations.

In the data memory 11B, each bingo card is associated with a serial number 29A which identifies the particular bingo card uniquely so that each bingo card can be retrieved from the memory by entry into the memory of the serial number 29A.

The present system allows each location and the manager of that location to customize the bingo session in that bingo cards can be printed to meet these requirements.

At the location 28, the manager of the bingo session can set up the bingo session to include a series of bingo games to be played during the session. The games are identified sequentially. Some of the games are full games that is all of the numbers are required to be marked in the card before the bingo game is won. In some games a pattern smaller than the entire field of twenty four numbers on the card is required to be marked in order to win. The manager can therefore select which games of the series are to be full games and which games are to be pattern games and this selection can be made in accordance with the requirements of the particular manager rather than as a set structure due to restrictions in the system. In addition the manager can select the number of bingo cards to be printed on a bingo paper or, alternatively can use sufficient paper from stock to constitute the inventory of a particular session or game.

Figure 2:
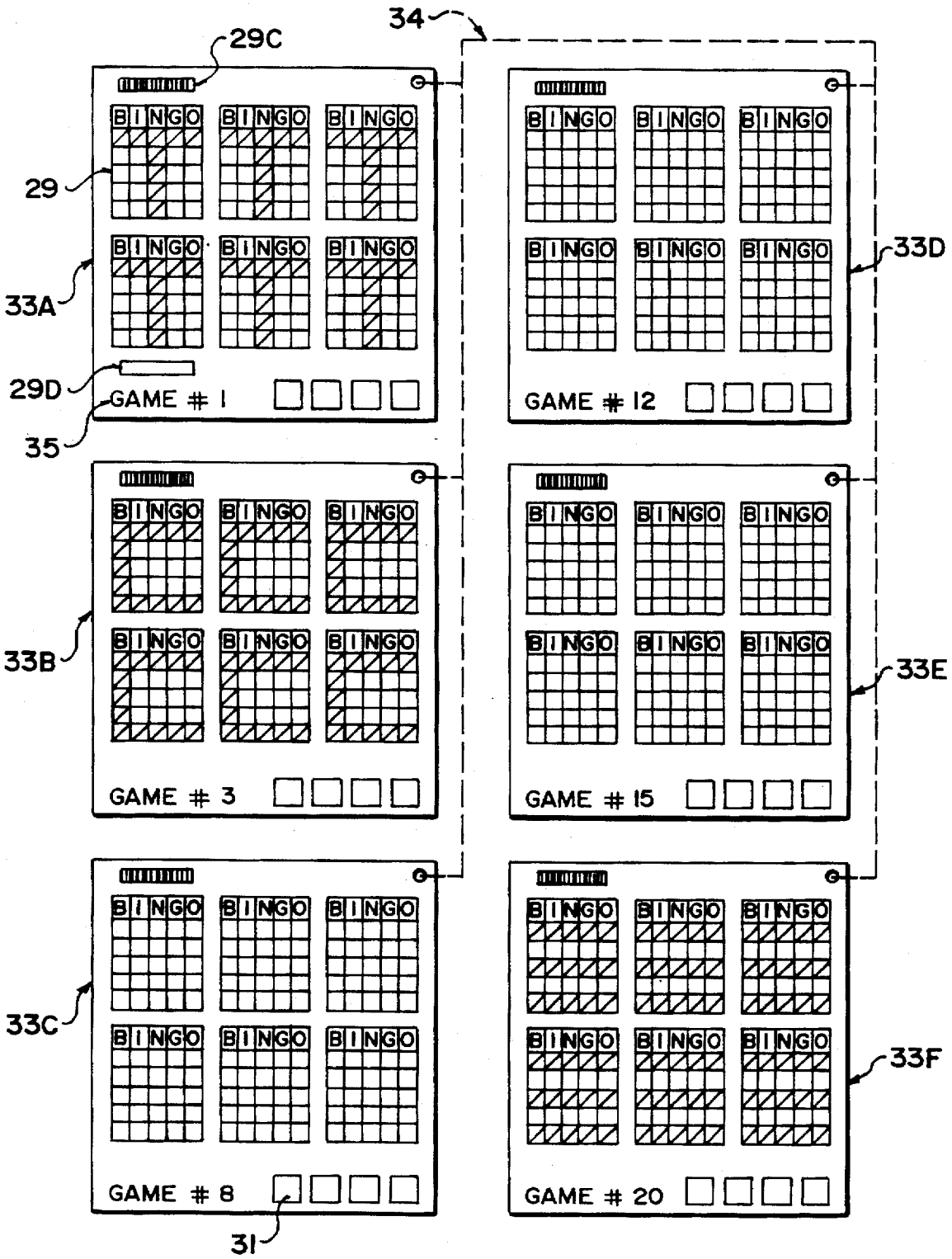
FIG. 2 is a schematic illustration of a book of bingo cards showing schematically only the interconnection between the papers to form a book.

Further the manager can customize the printed bingo cards by the addition of advertising information indicated schematically in FIGS. 1 and 2 at 31. Such advertising information can be in the form of coupons which the player can cut out and utilize for reductions in costs by the supplier of the advertising. The sale of such advertising and the collection of moneys from the advertisers for printing of the advertising can defray the cost of the printing paper or can lead to a profit which is additional to the conventional profits available from the bingo session.

The manager can select the books to be printed that is the association of the different games of the session which are put together to form a book.

The manager can select special books to be printed for example "Gold books" in which the winnings in each game are increased subject to an increased cost for the book.

The selections are introduced into the computer using the manual input in a conventional menu driven system so that all the above variables are selected in accordance with the manager's requirements. In most cases, the selection once entered is maintained constant for all further sessions to avoid confusion to the customers and to avoid changing the inventory of printed books and cards.

Further, the manager can customize the face of the bingo cards to contain only the fixed pattern in play for a particular game. For example as shown in FIG. 3, if the second game in a session consists of a fixed letter T pattern, with the pattern to be attained with the letter T as typed, the bingo cards for that game can be customized to show only the numbers N1 to N8 necessarily corresponding with the letter T. This customization has several advantages over bingo paper currently sold on the market: firstly, by removing extraneous numbers from the card in play, the customer cannot be confused about the pattern which must be obtained in order to have a winning card. It is therefore, less necessary to employ sophisticated colour coding techniques currently employed to ensure that the customer is playing the appropriate paper for the appropriate game. Secondly, players will be able to play their cards faster since it is not necessary for them to view, and ignore, numbers which are irrelevant to the game being played. Faster play results in the ability for the bingo hall to play a greater number of games within the same time frame and, secondly, for the player to play a greater number of tickets with greater accuracy. Thirdly, the player practice using traditionally available bingo paper of using their dabbers to "dabout" unwanted numbers on their cards would be eliminated. This results in the production of bingo paper which is more easily recyclable and, therefore, more environmentally friendly.

In the arrangement in FIG. 3, therefore, the computer extracts from the data memory the required bingo card including the full series of 24 numbers for printing in a matrix. However when the program is arranged to generate a reduced format game, for example the T-shape as shown, the printer is arranged to print only the numbers in the required format and to omit the other numbers which are not required for that particular game.

The printer 15 at the location 28 is then used to print a number of bingo cards onto paper for playing by the players. In FIG. 1 printed bingo cards are shown at 30 including the bingo card 29 and the advertising 31. It will of course be appreciated that each printed bingo card carries a different one of the series of bingo cards 29 from the data base until the series is completed following which the series is repeated.

The printed bingo card also carries the serial number 29A which is printed simply in numerical form at one point on the printed card for reading manually and may be printed at a second position on the card indicated at 29B in the form of a machine readable code which will generally be a bar code readable by a conventional laser bar code reader.

In FIG. 2 each printed bingo card indicated at 33 carries a plurality of the bingo cards 29 printed thereon. In the example shown there are six such bingo cards 29 but it will of course be appreciated that this number can be varied in accordance with requirements either determined by the system or determined by the bingo session manager as set forth above. In FIG. 2 six such bingo pages are shown indicated at 33A, 33B, 33C, 33D, 33E and 33F. If the pages are intended to be sold separately, each will carry a machine readable serial number 29C and the same serial number 29D printed for reading manually. The serial number 29C, 29D is selected for the page by the central computer during the printing process so that the serial number 29C, 29D is not the same as the individual serial number 29A for each bingo card but is instead selected as a separate serial number indicative of the six (or other number) of cards printed on page 33A.

Also in FIG. 2, there is shown the possibility of association of the pages 33A through 33F into a book by a coupling 34 shown schematically. In the event that the pages are intended to be sold as a book, the pages are coupled together in a manner which maintains them coupled during the storing and selling process but can of course be separated for playing by the player. In the event that the printed bingo cards are sold as a book, the serial number 29C, 29D is selected by the central computer to identify all of the cards of the book in association with the games of the session to which they relate. Thus, the sale of the book of printed bingo cards 33A through 33F will generally relate to a series of bingo games of the session and the game to which the bingo cards on each printed bingo card relate is identified on the card and indicated at 35. It is conventional in bingo sessions that the bingo players are required to purchase a book of this type as an entry fee with of course the encouragement when entered to purchase further books or further individual printed bingo cards during the session.

Generally the books which are sold as the "entry fee" do not contain printed bingo cards for each of the games of the session but only a selected number of those games.

In the present system, in view of the customization which is available of the games selected for printing, some of the games selected in the book can be of a different format from others of the games. Thus the printed bingo card 33A is a pattern game of a T-shape. This is selected as game #1. Printed bingo card 33B is selected for game #3 and is a pattern game of C-shape. Printed bingo card 33C, 33D and 33E are selected for games #8, #12 and #15 respectively and relate to full games. Printed card 33F is selected for game #20 and is another shape of pattern bingo game.

The printing process preferably but not essentially utilizes preprinted paper on which the basic matrix is already printed. Onto this preprinted material, the printer applies simply the numbers from the bingo cards 29 selected by the central computer for printing. In regard to the pattern games, the printer omits those numbers which are not required for the particular pattern selected.

Normally the books and printed cards are printed ahead of the session and placed into inventory for sale during the session. There is no necessity therefore to enter onto the printed cards the date or location involved for this can be entered if desired.

During the bingo session, the books and printed cards are sold to the players including the regular books necessary as entry fee, special books including a series of special games, gold books and individual printed cards.

The selling is effected both by a central cashier or cashiers and by floor runners who move from player to player selling the cards or books necessary for the next game or for subsequent games. Each of the persons selling the books and cards has an individual one of the code readers 16 and cannot sell such books or cards without access to the code reader.

Each code reader has two way communication through the input/output 17 to the central computer.

When a player wishes to purchase a book or printed card, that book or card has its code 29A read by the code reader 16. The serial number or code 29A is then fed back to the computer identifying the individual bingo card or the collection of bingo cards which are related to that code number. The central computer therefore receives information as to all of the bingo cards to be sold. In response to the receipt in the central computer of the information concerning the bingo cards to be sold, the central computer feeds back to the code reader 16 information defining the cost of the book or printed bingo card to be purchased. This price is displayed on the display screen 19 and assists the seller in properly collecting the required amount of cash for the purchase.

In addition, if one or more of the bingo cards to be sold is a duplicate of a card already sold, then the central computer denies the purchase and prevents the sale of that card to the player. Such a duplication can occur in the event that printed cards from the next printing of the series are sold for the same game as those from the previous printing of the series. As stated before normally the number of cards in the series is selected to be sufficient to ensure that separate cards can be used by all of the players for whatever number of cards they want to play with without the necessity for duplication. However in some cases it can occur that a duplication will arise due to the overlapping of the printed series particularly if the handling of the inventory is not properly managed. It is preferred therefore that any printed cards or books remaining from a previous session are sold first in a next session.

Before any bingo game is played, therefore, the central computer has input into its data memory 11B information identifying all of the bingo cards to be played in that particularly game. That information either arises from the timing of the selling of the printed bingo card that is immediately prior to the game to be played or the information arises from the identification in a book by the central computer of particularly bingo cards with particular games of the session. In most cases, however, each bingo game printed is associated with a particular game to be played and for this purpose the printed bingo card includes information indicated at 36 and 37 defining the game number and the type of format of game to be played.

The central computer can also be associated with the video display units 21. When these are used in conjunction with paper play, the video display unit receives from the central computer selected ones of the bingo cards 29 from the series of bingo cards and enters these on the video display unit. The selected ones do not include any of those entered into the central computer as sold on the printed bingo cards so that there is no duplication. The video display unit includes means indicated at 21A for receiving payment for the play of the bingo cards displayed and on receipt of the payment there is communication to a central computer confirming that the displayed bingo cards are sold and therefore properly entered into the game.

Thus when the game is commenced, the central computer has entered into the data memory information defining all of the bingo cards 29 from the series which have been sold for that game and are therefore entered properly into the game for play.

During the game, the bingo caller enters the numbers called via the manual input into the central computer. The central computer stores for each game a record of all of the numbers called and maintains that stored information after the game is completed. The central computer also plays the game simultaneously on each of the bingo cards 29 entered properly into the game for play. The central computer therefore identifies and displays on the monitor 13 when a card in play is a winning card. The central computer cannot identify who is the winner since there is no information concerning the identities of the players. The information is not used to inform the players since it is of course a rule of bingo that a winner cannot be claimed unless the call of "BINGO" is made at the time of winning.

When a winning bingo card is called by a player either simultaneously with the computer display or subsequently if a player has failed to properly identify a winning card, that winning card as indicated schematically at 30A is carried to the bingo caller who can use either a portable reader to scan the bar code or can manually read the serial number 29A and manually enter into the input 12. The input of the serial number 29A is used by the central computer to identify the bingo card 29 and this can be used to display on terminals in the location and to check whether the winning bingo card 30A is properly a winning card and is properly one of those sold for that game. If the card is not a winning card or has not been properly sold, this is displayed on the display monitor 13 so that the called winning bingo card can be discarded and the game continued.

The central computer also enters onto the display monitor 13 information when two or more bingo cards are simultaneously winners so that the bingo caller knows that there are other winners on the floor but have not been called. The central computer therefore knows how many winners there are when the winning bingo card is called and therefore prevents the bingo caller or any one associated with the bingo caller from entering as winning cards bogus cards or duplicates of the winning card so as to prevent the bingo caller from improperly dividing the prize between the actual winner and an accomplice.

After a game or series of games are played, the computer collates the information concerning the number of bingo cards sold for each game and for the series of games, the amount of money represented by the sales, the number of winning bingo cards, the number of winning bingo cards called and the prizes paid out. This collated information is displayed on the monitor 13 and is transmitted on the telephone interface 14 to one or more predetermined authorized recipients. The recipients can include gaming authorities, bingo management or charitable organization receiving payments from the bingo sessions.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of playing by a plurality of players a plurality of bingo games in a bingo session comprising:

providing a central computer having a memory;

placing in the memory a plurality of unique bingo cards;

providing a plurality of printed bingo papers each having at least one of the plurality of bingo cards printed thereon, each printed bingo paper of the plurality of printed bingo papers having associated therewith and printed thereon a respective one of a plurality of printed machine readable codes, each printed machine readable code identifying the respective bingo paper;

for each bingo game of the plurality of games, selling to the players at least some of the printed bingo papers;

at a time of selling each sold printed bingo paper, using code reader means to read the printed machine readable code associated with said each sold printed bingo paper to input into the central computer information identifying all of the printed bingo papers sold for said each bingo game;

storing in the memory of the central computer information identifying all of the bingo papers and said at least one bingo card thereon sold for each game of the plurality of games;

causing the central computer to determine whether any proposed sale of a bingo paper which is a duplicate of one already sold for said each bingo game and to communicate to the code reader means when the proposed sale of a bingo paper is a duplicate and therefore denied;

playing each bingo game of the plurality of games in turn by continuing to call bingo numbers until a claimed winning bingo card of said each bingo game is identified by a player;

after a claimed winning bingo card is identified, using said code reader means to read said printed machine readable code printed on the bingo paper carrying the claimed winning bingo card;

and causing the code reader means to communicate to the central computer said printed machine readable code for comparison with said identifying information to verify that the claimed winning bingo card is properly one of the bingo cards sold for said each bingo game.

2. The method according to claim 1 wherein the code reader means includes a plurality of portable code readers and wherein each portable code reader is carried by a person for selling printed bingo cards to the players.

3. The method according to claim 1 wherein the code reader means includes a plurality of portable code readers each carried by a person selling printed bingo cards to the players and wherein said printed machine readable code printed on the bingo paper carrying the claimed winning bingo card is read using one of the portable code readers.

4. The method according to claim 1 including printing at least some of the bingo papers in books of papers, associating with each book a single printed machine readable code and, on reading the single printed machine readable code associated with one of said books when sold, inputting into the central computer information identifying as sold all the printed bingo cards in said one of said books.

5. The method according to claim 4 wherein at least some of the bingo cards of each book are arranged for playing in different games of the plurality of games and wherein the information input into the central computer identifies all the bingo cards of said book sold in association with the bingo games for which they are arranged for playing.

6. The method according to claim 1 including providing in said plurality of bingo games at least some games of a reduced format in which a winning bingo card requires calling of only those numbers of a matrix of the numbers of the printed bingo cards in a predetermined pattern; and printing, for the printed bingo cards required for the games of reduced format, only those numbers of the matrix of the printed bingo cards which fall within the predetermined pattern.

7. The method according to claim 1 including:

placing in the memory of the central computer a plurality of individual groups of bingo cards and arranging each card in each of the individual groups such that each card is unique relative to all other cards of the plurality of individual groups;

printing a plurality of sets of printed bingo card papers, each set of printed bingo card papers having on each printed bingo card paper of the set a plurality of bingo cards which plurality is different from a plurality of bingo cards on the printed bingo card papers of others of the sets of printed bingo card papers;

and, for each set of printed bingo card papers, selecting for printing thereon bingo cards from a different one of the plurality of individual groups of bingo cards.

8. A method of playing by a plurality of players a plurality of bingo games in a bingo session comprising:

providing a central computer having a memory;

placing in the memory of the central computer a plurality of unique bingo cards having a matrix of numbers arranged in five columns and a plurality of rows;

providing in the plurality of bingo games at least some games of a reduced format in which a winning bingo card requires calling of only those numbers of the matrix of the numbers of the bingo cards in a predetermined pattern;

providing at least some of the plurality of bingo cards printed on paper to form a number of printed bingo papers, each printed bingo paper having at least one of the bingo cards printed thereon;

for each bingo game of the plurality of games, selling to the players at least some of the printed bingo papers;

and printing on the printed bingo papers, for the bingo cards required for the games of reduced format, only those numbers of the matrix of the bingo cards which fall within the predetermined pattern.

9. A method of playing by a plurality of players a bingo game comprising:

providing a central computer having a memory;

placing in the memory a plurality of unique bingo cards;

providing a plurality of printed bingo papers each having at least one of the plurality of bingo cards printed thereon, each printed bingo paper of the plurality of bingo papers having associated therewith and printed thereon a respective one of a plurality of printed machine readable codes, each machine readable code identifying the respective bingo paper;

selling to the players at least some of the printed bingo papers;

at a time of transaction of a sale of each printed bingo paper sold, using code reader means to read the printed machine readable code associated with said each printed bingo paper sold to input into the central computer information identifying all of the printed bingo papers sold for the bingo game;

storing in the memory of the central computer information identifying all of the bingo papers and said at least one bingo card thereon sold for the bingo game;

causing the central computer to determine during said transactions any bingo paper which is a duplicate of a paper already sold for said bingo game and to communicate to the code reader means when the proposed sale of a bingo paper is a duplicate and therefore denied;

and playing the bingo game by calling bingo numbers until a winning bingo card is identified.

10. The method according to claim 9 wherein the code reader means includes a plurality of portable code readers each of which is carried by a person for selling printed bingo cards to the players and wherein the central computer communicates to at least one of the portable code readers when a sale of a bingo card is denied.

11. The method according to claim 9 including printing at least some of the bingo papers in books of papers, associating with each book a single machine readable code and, on reading the single machine readable code associated with one of said books when sold, inputting into the central computer information identifying as sold all the printed bingo cards in said one of said books.

12. The method according to claim 9 wherein the bingo game is a bingo game of a reduced format in which a winning bingo card requires calling of only those numbers of a matrix of the numbers of the printed bingo cards in a predetermined pattern; including printing, for the printed bingo cards required for the bingo game of reduced format, only those numbers of the matrix of the printed bingo cards which fall within the predetermined pattern.

13. The method according to claim 9 including:

placing in the memory of the central computer a plurality of individual groups of bingo cards and arranging each card in each of the individual groups such that each card is unique relative to all other cards of the plurality of individual groups;

printing a plurality of sets of printed bingo card papers, each set of printed bingo card papers having on each printed bingo card paper of the set a plurality of bingo cards which plurality is different from a plurality of bingo cards on the printed bingo card papers of others of the sets printed bingo card papers;

and, for each set of printed bingo card papers, selecting for printing thereon bingo cards from a different one of the plurality of individual groups of bingo cards.

* * * * *